US011866937B2

(12) United States Patent
Frantz et al.

(10) Patent No.: US 11,866,937 B2
(45) Date of Patent: Jan. 9, 2024

(54) GASKETED CEILING SYSTEM

(71) Applicant: ARMSTRONG WORLD INDUSTRIES, INC., Lancaster, PA (US)

(72) Inventors: William H. Frantz, Elizabethtown, PA (US); Peter J. Oleske, Lancaster, PA (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

(21) Appl. No.: 17/525,505

(22) Filed: Nov. 12, 2021

(65) Prior Publication Data

US 2022/0154465 A1 May 19, 2022

Related U.S. Application Data

(60) Provisional application No. 63/113,539, filed on Nov. 13, 2020.

(51) Int. Cl.
*E04B 9/24* (2006.01)
*E04B 9/06* (2006.01)

(52) U.S. Cl.
CPC ..... *E04B 9/244* (2013.01); *E04B 9/067* (2013.01)

(58) Field of Classification Search
CPC ..... E04B 9/244; E04B 9/067
See application file for complete search history.

(56) References Cited

U.S. PATENT DOCUMENTS 4,611,444 A * 9/1986 Nassof ..... E04B 9/0435 181/290
4,967,530 A 11/1990 Clunn
5,033,247 A * 7/1991 Clunn ..... E04B 9/02 52/204.591
5,411,072 A * 5/1995 Starck ..... E06B 3/94 160/84.11
6,701,686 B1 3/2004 Platt
(Continued)

FOREIGN PATENT DOCUMENTS

JP 2019-004348 A 12/2021

OTHER PUBLICATIONS

Written Opinion for PCT/US2021/059188 (7 pages). (dated 2022).*
International Search Report for Corresponding Application PCT/US2021/059188, dated Mar. 3, 2022.

*Primary Examiner* — Rodney Mintz
(74) *Attorney, Agent, or Firm* — Patrick Sheldrake

(57) ABSTRACT

A suspended ceiling system in one embodiment includes a grid support member and a ceiling panel supported on the member. A resiliently compressible gasket is disposed at the interface between the grid support member and peripheral edge of the panel. The gasket may be fixedly attached to the panel peripheral edge in the factory under controlled conditions before shipment to the ceiling installation site. In one embodiment, the gasket may be adhesively attached to the panel. Mounting the ceiling panel on the grid support member compresses the gasket to preferably form a minimally visible air leakage resistant seal between the air plenum space above the ceiling panels and the occupied space below. This retards air exchange between the spaces which enhances heating/cooling efficiency, noise reduction and allows formation of pressurized clean rooms.

19 Claims, 8 Drawing Sheets

(56) References Cited

U.S. PATENT DOCUMENTS

| | | | | |
|---|---|---|---|---|
| 7,062,886 | B2 * | 6/2006 | Auriemma | E04B 9/242 52/489.1 |
| 7,260,919 | B1 | 8/2007 | Spransy | |
| 7,798,287 | B1 | 9/2010 | Surace | |
| 8,291,667 | B2 | 10/2012 | Jahn | |
| 8,979,963 | B2 * | 3/2015 | Yang | E04B 9/244 55/483 |
| 8,997,426 | B1 | 4/2015 | McLeod | |
| 9,175,473 | B2 | 11/2015 | Kaump | |
| 2005/0060850 | A1 | 3/2005 | Auriemma | |
| 2009/0000231 | A1 * | 1/2009 | Burns | E04B 9/30 52/506.07 |
| 2015/0000236 | A1 * | 1/2015 | Yang | E04B 9/064 55/482 |
| 2023/0111321 | A1 * | 4/2023 | Persson | E04B 9/02 52/506.01 |

* cited by examiner

Means and Std Deviations

| Level | Number | Mean | Std Dev |
|---|---|---|---|
| None | 9 | 13.6 | 6.3 |
| Lamatek 33314 | 6 | 7.4 | 2.9 |
| Preson PF1606W | 6 | 6.7 | 0.7 |
| FrostKing Foam V443B | 11 | 2.5 | 2.0 |

Excluded Rows 20

GASKETED CEILING SYSTEM

CROSS-REFERENCE TO RELATED APPLICATIONS

This application claims the benefit of U.S. Provisional Application No. 63/113,539, filed on Nov. 13, 2020. The disclosure of the above application(s) is (are) incorporated herein by reference.

FIELD

The present invention relates to suspended ceiling systems, and more particularly to such systems comprising ceiling panels including gaskets for forming a seal with the support grid.

BACKGROUND

Numerous types of suspended ceiling systems and methods for mounting ceiling panels have been used. One type of system includes a suspended support grid including an array of intersecting grid support members configured to support and hang a plurality of individual ceiling panels therefrom. It is desirable in some cases to minimize air exchange at the interface between peripheral edges of the ceiling panels and the grid support members to isolate the captive space or plenum above the grid and ceiling panels from the occupied room space below. This may be used in conjunction with improving noise blocking between interior spaces, HVAC (heating ventilation and air conditioning) system efficiency improvement, smoke control during a fire event, or for creating pressurized clean room environments.

Prior attempts at forming an air leakage resistant seals between ceiling panels and grid support members typically entail manually installing seals or gaskets in the field on the job site during installation of the ceiling system. This has proven to be a time consuming process which delays installation and may result in inferior sealing at the panel to grid interface since the jobsite is not a controlled environment creating exposure to building construction dust and debris. In addition, the prospects of obtaining a well sealed ceiling system is highly variable being dependent upon the skill and experience of the ceiling installers subject to time pressure to complete the job quickly and on schedule.

Improvements in air-sealed ceiling panel systems are desired.

SUMMARY

A gasketed ceiling system is provided which forms an air leakage resistant seal at the interface between peripheral edges of the ceiling panels and the ceiling support grid. The gasket may be applied to the ceiling panel in the factory in a controlled environment as part of the inline ceiling panel fabrication process assembly line in the factory before the products are shipped to the field for installation. This eliminates problems with the foregoing field-installed ceiling panel to grid gaskets and provides repeatable good results in obtaining a properly installed gasket. In one embodiment, the gasket may be formed of polymeric foam of certain density and thickness, as further described herein. Other types of gasket materials may be used in other embodiments.

In one non-limiting embodiment, the gasket may be formed of cross-linked polyethylene (PE) foam. The ceiling panel may have a weight selected to compress the gasket by at least about 10 percent of the uncompressed thickness of the gasket, and about 50 percent in one preferred implementation using a 4 lbs./cu. ft. (pounds/cubic foot) PE foam loaded by a 4 lb. ceiling panel. This achieves a good, low leakage seal without the need for additional clips, weights, or springs to impart additional weight load onto the gasket for compression. The gasket may be adhesively adhered to the load bearing surface defined by the peripheral edge of the ceiling panel which rests on the support grid.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The features of the exemplary embodiments of the present invention will be described with reference to the following drawings, where like elements are labeled similarly, and in which.

Figure 1:
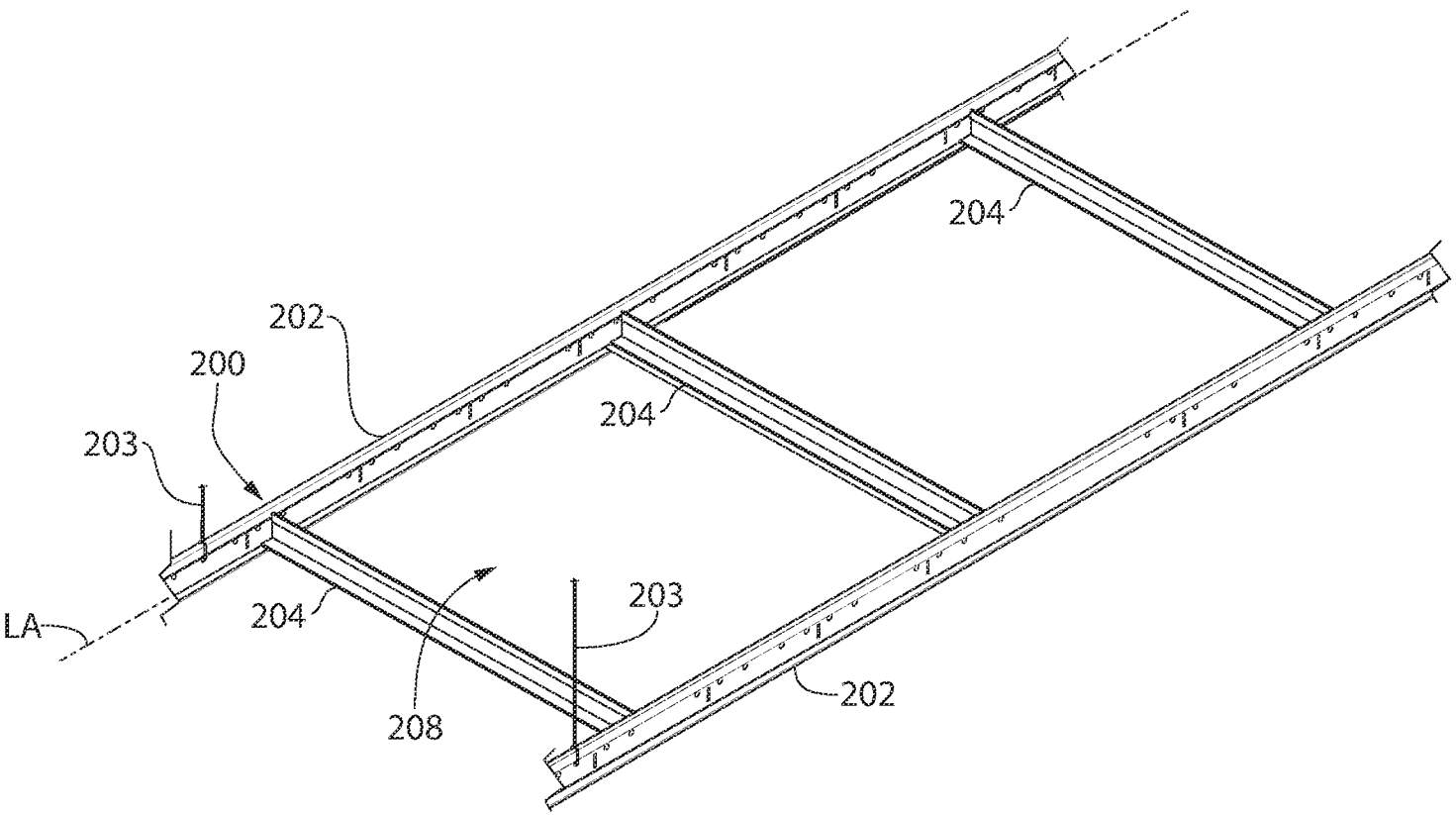
FIG. 1 is a top perspective view of a support grid for a suspended ceiling system.
Figure 2:
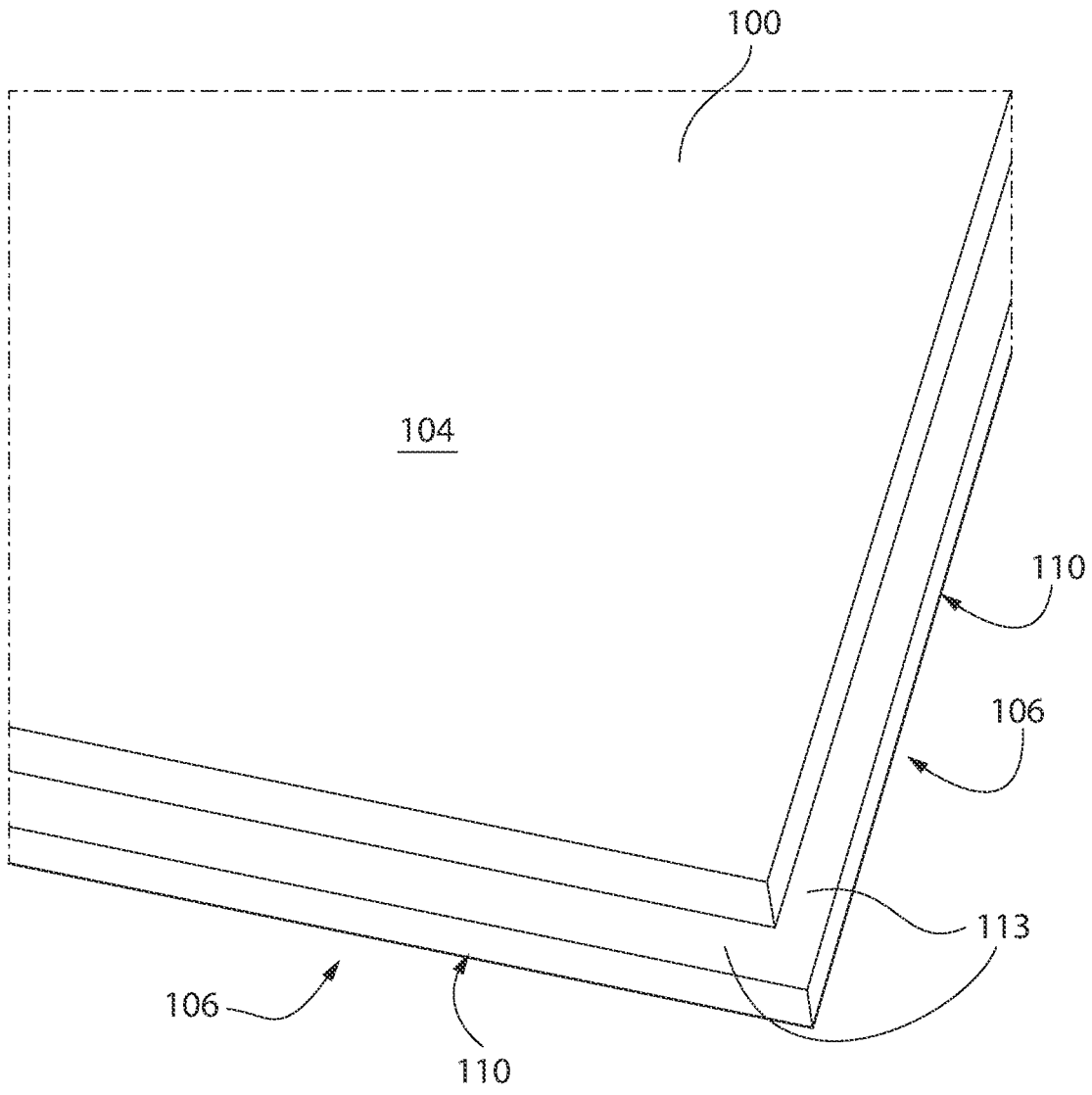
FIG. 2 is an bottom perspective view of a ceiling panel mountable in the support grid of FIG. 1.
Figure 3:
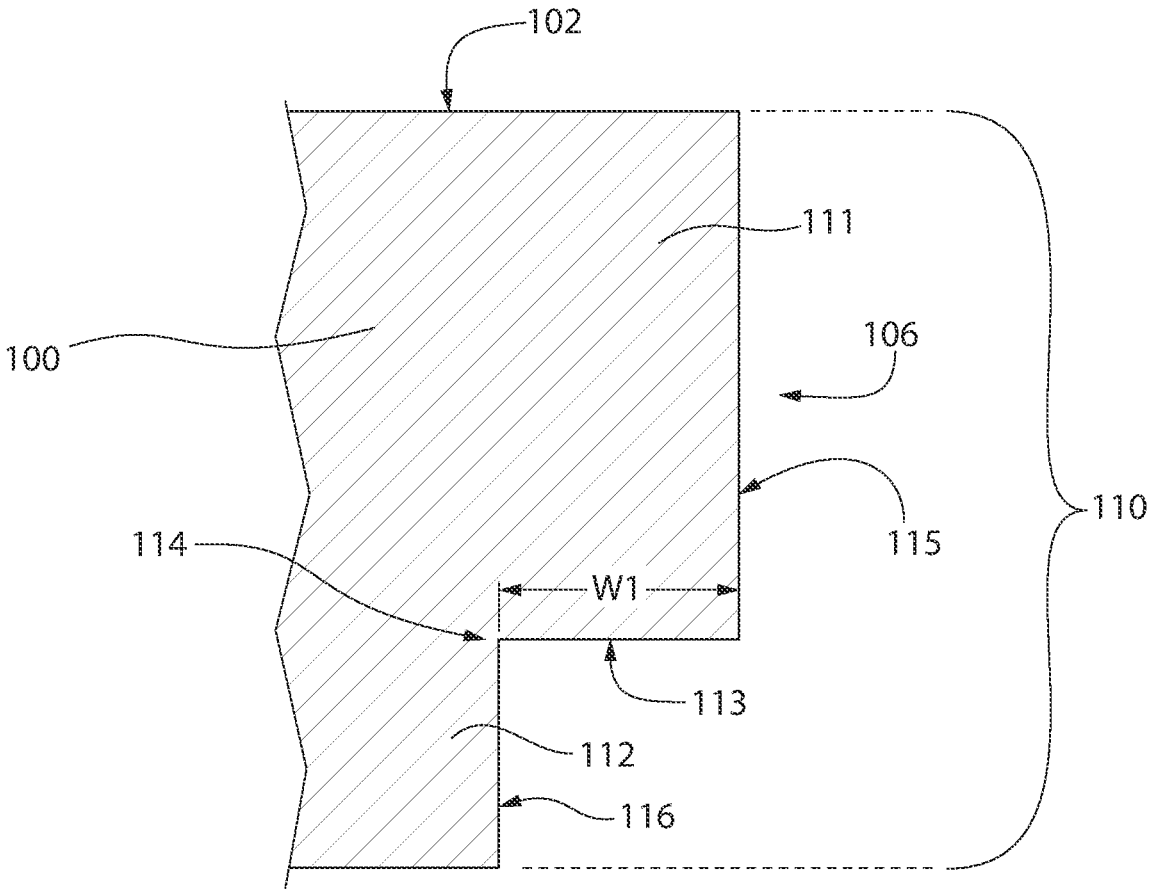
FIG. 3 is a transverse cross-sectional side view of the edge detail of one embodiment of the ceiling panel.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION

The features and benefits of the invention are illustrated and described herein by reference to exemplary ("example") embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly,"

"upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range.

FIGS. 1-4 depict a gasketed ceiling system according one non-limiting embodiment of the present disclosure. The ceiling system generally includes an overhead support grid 200 and plurality of ceiling panels 100 each supported at their peripheral edges 110 by the grid. A perimetric air seal is formed by gasket 150 disposed at the mounting interface between the support grid and the ceiling panels, as further described herein. In one embodiment, gasket 150 may be fixedly attached to the peripheral edges of the ceiling panel in the factory before shipment to the installation job site and is an integral part of the standard gasketed ceiling panel product.

The overhead support grid 200 is configured for mounting in a suspended manner from an overhead building support structure via appropriate hanger elements 203, such as for example without limitation fasteners, hangers, wires, cables, rods, struts, etc. Support grid 200 includes a plurality of intersecting longitudinal grid support members 202 and lateral grid support members 204. Longitudinal and lateral grid support members 202, 204 are elongated in shape having a length greater than their respective width (e.g. at least twice), and in various embodiments lengths substantially greater than their widths (e.g. 3 times or more). Longitudinal grid support member 202 may have a substantially greater length than lateral grid support member 204 and form "runners" or "rails" which are maintained in a substantially parallel spaced apart relationship by the lateral grid support members which form cross bracing members. The lateral grid support members 204 may be attached to and between adjacent (but spaced apart) longitudinal grid support members 202 at appropriate intervals using any suitable permanent or detachable coupling means. The combination of interconnected longitudinal and lateral grid support members 202, 204 provides strength and lateral stability to the support grid 200.

In one embodiment, the longitudinal and lateral grid support members 202, 204 may be horizontally oriented when installed. It will be appreciated, however, that other suitable mounted orientations of grid support members 202, 204 such as angled or sloped (i.e. between 0 and 90 degrees to horizontal) may be used. Accordingly, although support members 202, 204 may be described in one exemplary orientation herein as horizontal, the invention is not limited to this orientation alone and other orientations may be used.

Longitudinal and lateral grid support members 202, 204 intersect to form an array of grid openings 208 which become essentially closed by ceiling panels 300 and 320 when positioned within the openings. In some embodiments, the grid support members 202, 204 may be arranged in an orthogonal pattern wherein the support members intersect at right angles (perpendicularly) to each other to form rectilinear grid openings 208 such as squares or rectangles (in top plan view). The terminal ends of the lateral grid support members 204 may be configured for permanent or detachable connection to the longitudinal grid support members 202 at right angles to form a rectilinear grid pattern using any suitable means. Non-limiting examples of suitable connection means include welding, soldering, clips, brackets, threaded fasteners, interlocking tabs/slots, etc. Such techniques are known in the art. Accordingly, the present invention is not limited by the manner of lateral to longitudinal grid support member attachment used.

Figure 4:
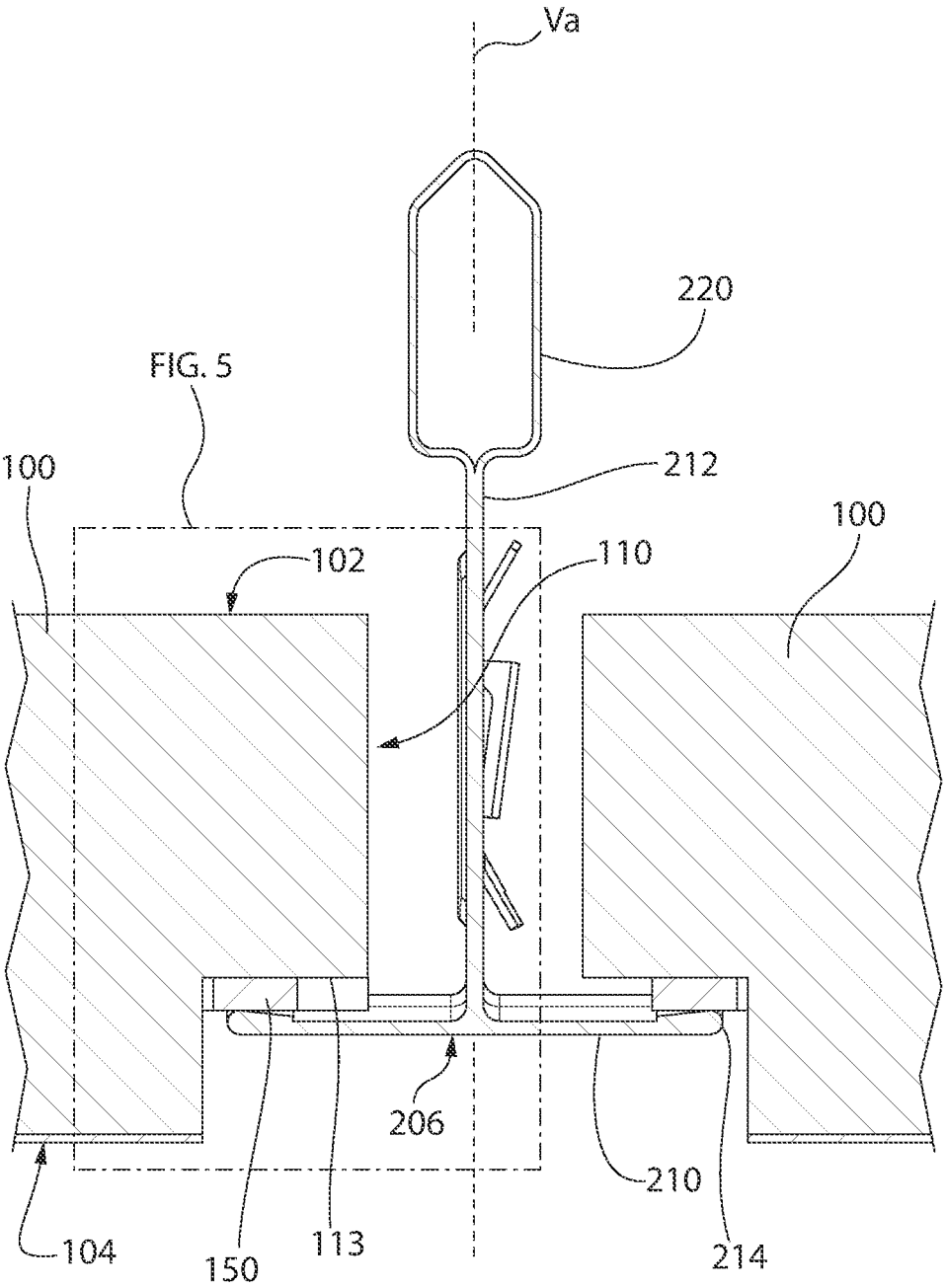
FIG. 4 is a partial side cross-sectional view of a ceiling system comprising the support grid, ceiling panels, and a resiliently compressible gasket at the interface between the grid and panels for forming an air leakage resistant seal therebetween.
Figure 5:
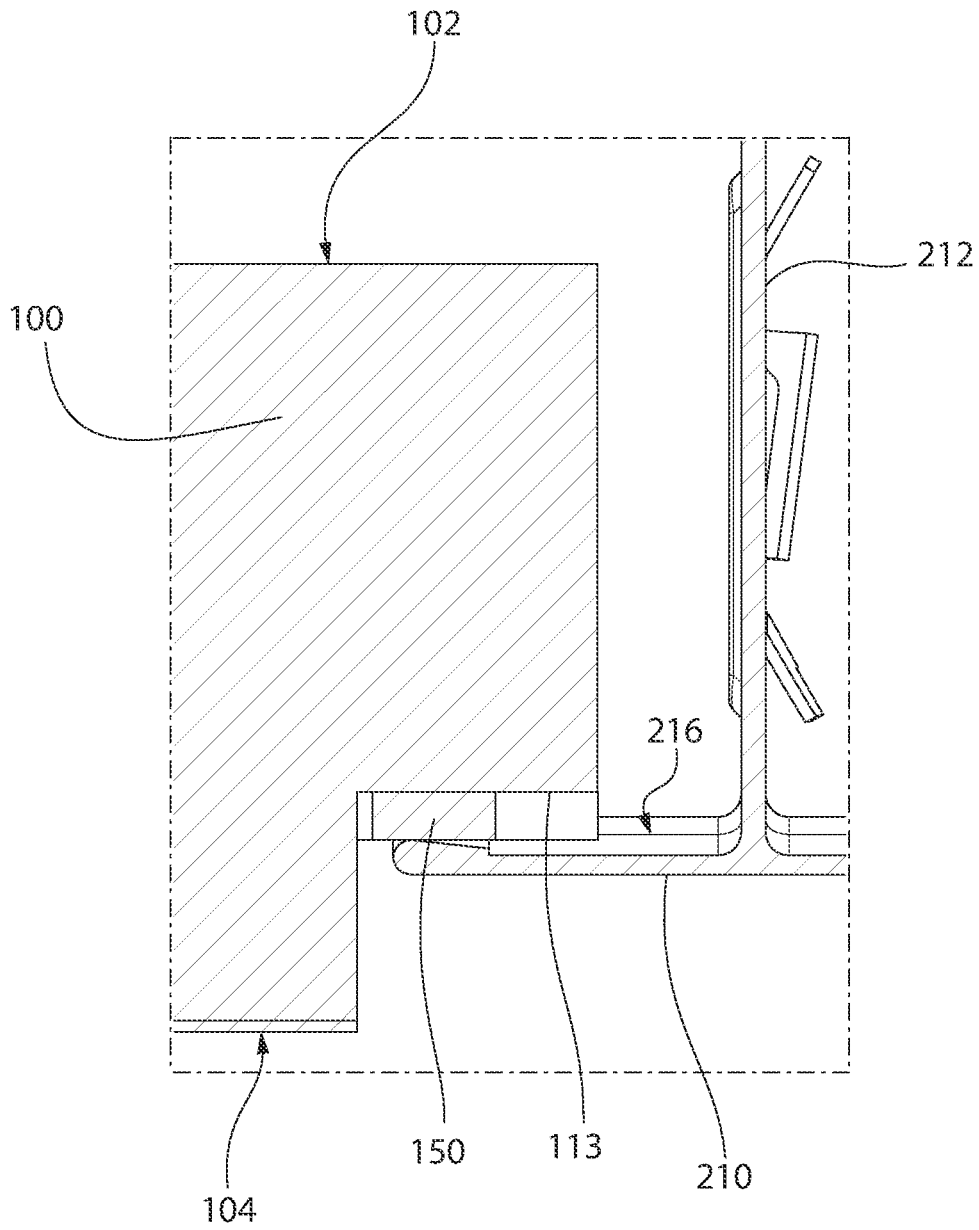
FIG. 5 is an enlarged detail from FIG. 4.
Figure 6:
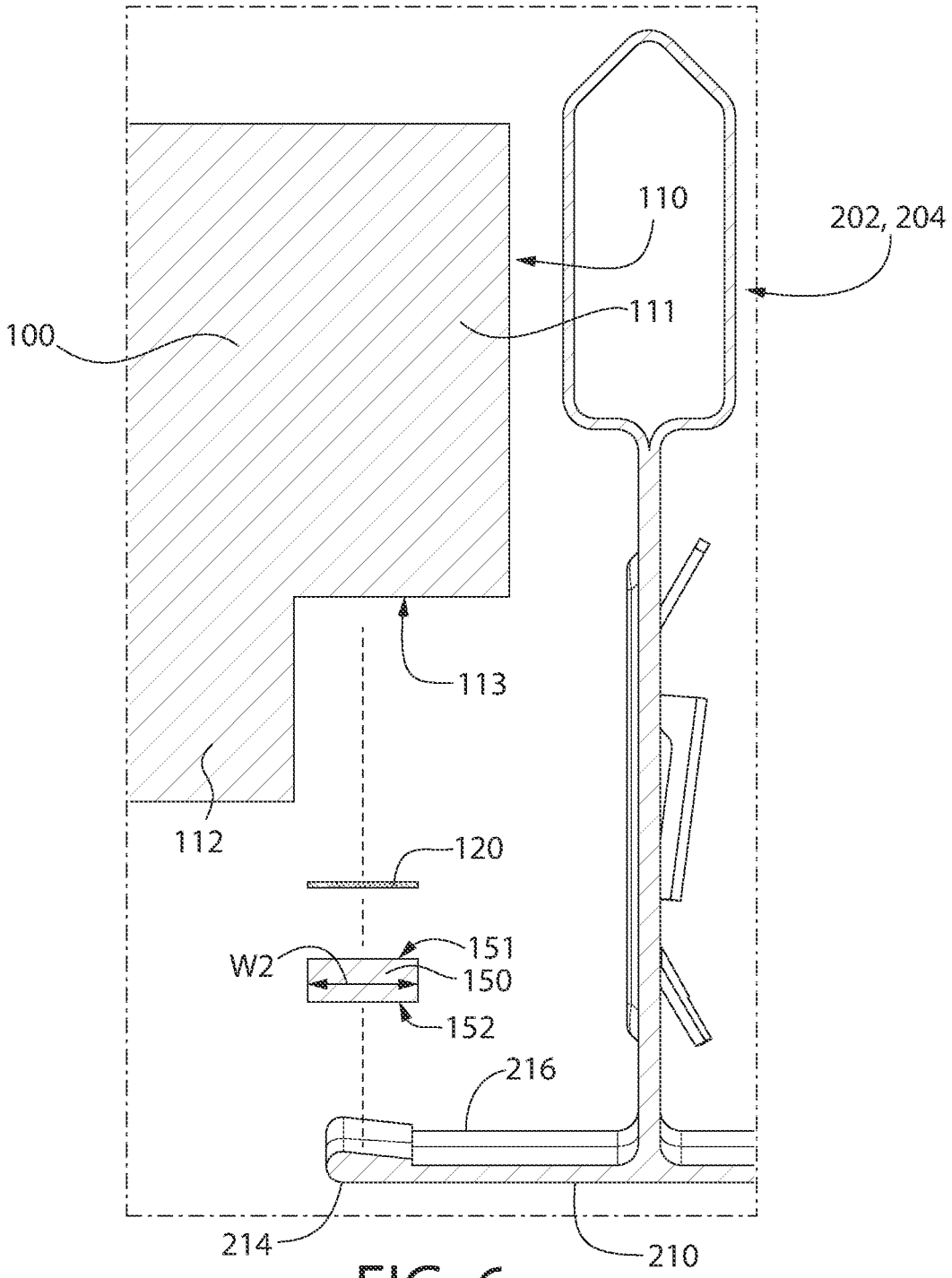
FIG. 6 is an exploded view of the ceiling system.

With particular reference to FIGS. 1 and 4, grid support members 202, 204 may be T-shaped (e.g. T-rails) in transverse cross section in one non-limiting embodiment. Other shaped grid support members including various tubular or complex configurations and constructions may be used in the other ceiling systems so long as the grid support member includes a support surface operable to compress the gasket 150 for forming an air leakage resistant seal with the ceiling panel. The grid support members in the illustrated embodiment have an inverted T-shaped configuration in an installed position when suspended from an overhead building ceiling support structure. Grid support members 202, 204 may each include a longitudinally-extending horizontal bottom flange 210, an enlarged top stiffening channel 220 in some constructions, and a vertical web 212 extending upwards from the flange to the stiffening channel. In some embodiments, the top stiffening channel 220 may be omitted from grid support members 202 and/or 204.

The longitudinal and lateral grid support members 202, 204 each define a respective longitudinal axis LA and axial directions; the lateral grid support members 204 being arranged transversely thereto and defining a transverse direction which may be perpendicular. Bottom flange 210 is substantially horizontally oriented when in an installed position of the grid support members in the embodiment shown (see, e.g. FIGS. 1 and 2) and has opposing portions which extend laterally outwards from centrally located web 212 and terminate in opposed axially extending longitudinal edges 214. Web 212 may therefore be centered between the edges 214 of bottom flange 210 and vertically aligned with the vertical centerline CL of the grid support member in some embodiments. In other embodiments, the web 212 may be laterally offset from centerline CL1 of the grid support member 202 or 204 to one side or the other.

With continuing reference to FIGS. 1 through 4, the bottom flanges 210 of grid support members 202, 204 each includes a downward facing bottom surface 206 that defines the exposed grid face typically visible from the occupied room or space 250 below the support grid 200. Bottom surface 206 defines a horizontal ceiling reference plane for the overhead support grid 200. Flange 210 further defines a top upward facing support surface 216 for positioning and supporting the ceiling panels 110 thereon.

Longitudinal and lateral grid support members 202, 204 may be made of any suitable metallic or non-metallic materials structured to support the dead weight or load of ceiling panels 300 without undue deflection. In some non-limiting embodiments, the grid support members may be made of metal including aluminum, titanium, steel, or other. In some non-limiting embodiments, the grid support members 202 may be a standard heavy duty 15/16 inch aluminum T-rail having a 15/16 inch grid face, or 9/16 inch T-rail having a narrow 9/16 inch grid face.

The gasketed ceiling panels 100 will now be described in further detail. Referring now FIGS. 2-7, ceiling panels 100 may have a generally flattened broad body with a substantially greater horizontal width and length than vertical thickness Tp as shown. Ceiling panel 300 includes a top major surface 102, bottom major surface 104, and lateral sides 106 extending therebetween around a perimeter of the ceiling panel. Top and bottom surfaces 102, 104 may be generally planar and arranged substantially parallel to each other in one non-limiting embodiment.

Lateral sides 106 of ceiling panel 100 are defined by plural intersecting peripheral edges 110 which form the perimeter of the panel. Ceiling panels 100 may have various types of peripheral edge configurations including for example without limitation square edge panels, stepped tegular edge panels creating a reveal, angled/sloping edges, or various combinations thereof and other shapes entirely. The edge profile does not limit the invention.

Peripheral edges 110 may have a tegular edge profile in one non-limiting embodiment as shown. Tegular edges comprise a flanged upper edge portion 111 which projects laterally outwards and overhangs an inset lower edge portion 112. A stepped corner 114 is formed therebetween. The tegular edge further comprises laterally facing upper vertical side surface 115 and lower vertical side surface 116 which is vertically offset from the upper vertical side surface.

The underside or bottom surface of upper edge portion 111 defining a downward facing load bearing surface 113 which is configured and arranged to engage corresponding upward facing panel support surface 216 of the grid support members 202, 204 (see, e.g. FIG. 4). Load bearing surface 113 may be horizontal in one embodiment. In the case of using conventional square-edged ceiling panels without the stepped edge profile, it bears noting that the peripheral portion of the bottom major surface of the panel which extends perimetrically around the panel which rests on the grid support members defines the load bearing surface. The gasket 150 may be used with ceiling panels having any type of peripheral edge configuration so long as a horizontal load bearing surface is provided to engage the grid support members.

After the tegular edges of the ceiling panel 100 are cut to shape in the factory, the raw cut edges may sealed via a standard edge coating process which is a known process in the art. This applies a paint-like coating to the raw edges which seals the peripheral edges, and is particularly useful for mineral fiber panels to preclude the ingress of moisture. One side of the resiliently compressible gasket 150 is fixedly attached to the ceiling panel 100 onto the edge coating material in one embodiment. The opposite side of the gasket is free to engage the grid support members 202, 204 when the ceiling panel is mounted to the grid. If the edges of the ceiling panel are not sealed with edge coating, the gasket is instead fixedly attached directly to the raw cut edge.

The edge coating fluid (e.g. a liquid) may be discussed in terms of a paint which is applied to the edge of the workpiece such as a ceiling panel. The paint may be water-based and may include polymers. However, as is known to those of skill in the art, the liquid can also be a primer, a lacquer, a preservative, or any other desired treatment liquid that is appropriate as a coating for a particular workpiece and the intended utilization of that workpiece. In addition, the liquid may serve as a carrier for solid or filler particles. For example, the filler particles may have an average particle size ranging from about 100 microns to 600 microns, and the liquid carrier may have a composition of up to 90% of filler particles by dry solids weight. Some examples of filler particles includes calcium carbonate, dolomite, dolomitic limestone or combinations thereof. In addition to the solid or filler particles, the liquid may also include as part of its composition a binder and/or a pigment, as desired by design choice for a particular coating application. Examples of binders that may be included in the liquid include natural polymers, modified natural polymers, synthetic polymers and combinations thereof. The synthetic polymers are formed from the following monomers: vinyl acetate, vinyl propionate, vinyl butyrate, ethylene, vinyl chloride, vinylidine chloride, vinyl fluoride, vinylidine fluoride, ethyl acrylate, methyl acrylate, propyl acrylate, butyl acrylate, ethyl methacrylate, methyl methacrylate, butyl methacrylate, hydroxyethyl methacrylate, styrene, butadiene, urethane, epoxy, melamine, ester, and combinations thereof. U.S. Pat. No. 7,033,963, the disclosure of which is incorporated herein by reference in its entirety, describes other examples of liquids that may be used with the coating system described below. The coating system may also be used with other types of liquids (and liquid compositions), other than those referenced herein.

Ceiling panels 100 may have various overall polygonal and non-polygonal shapes (defined by the top and bottom major surfaces 102, 104 when facing those surfaces). Non-limiting examples include without limitation rectilinear (e.g. square comprising four equal length sides or rectangular comprising two opposing long sides/two opposing short sides), triangular, hexagonal, circular, oval, and others and various combinations thereof in a single ceiling system. In the illustrated embodiment, rectilinear ceiling panels are shown as an example.

Ceiling panels 100 may be constructed of any suitable material or combinations of different materials used in the industry. Some non-limiting examples of ceiling panel materials that may be used include, without limitation, mineral fiber board, fiberglass, metals, metal clad non-metallic filled or honeycomb cores, polymers, wood, various composites, combinations thereof, or other. In one embodiment, the panels 100 may be formed of mineral fiber board. Ceiling panels 100 may be acoustic panels in some embodiments with an NRC (noise reduction coefficient of at least about 0.65 in some embodiments. Acoustic mineral fiber panels when used for noise reduction typically have a higher fiberglass or mineral wool content than non-acoustic panels which provide better sound absorption and blocking. Suitable ceiling panels 100 which may be used are available from Armstrong World Industries of Lancaster, Pennsylvania.

The ceiling panels 100 may have a variety of sizes, thicknesses, and weight. Examples of sizes for rectilinear shaped panels may include without limitation 24 inch×24 inch, 24 inch×48 inches, or other as shipped from the factory (without field cutting/modification to fit building features and room sizes). Panels 100 may have any suitable thickness Tp, such as typically about ¾ inches in some embodiments, or more or less in other embodiments.

The resiliently compressible gasket 150 in one arrangement may be attached to the downward facing load bearing surface 113 on the tegular peripheral edge 110 of ceiling panel 100. This positions the gasket to engage and rest upon the upward facing support surface 216 of grid support members 202, 204 when the ceiling panel is mounted in the field. Gasket 150 is compressed by the weight of the panel.

Gasket 150 may be linearly elongated to extend along the entire peripheral edge 110 of the ceiling panel 100 in a continuous uninterrupted strip or piece of gasketing. The gasket may have a rectilinear transverse cross-sectional shape in some embodiments as shown, or other shapes including various polygonal or non-polygonal configurations. Gasket has a top side 151 fixedly attached to peripheral edge 110 of the panel, and an opposite bottom side 152 positioned to engage the bottom flange 210 of grid support members 202, 204. In one arrangement, gasket 150 may have a lateral width W2 less than the lateral width W1 of the downward facing panel edge load bearing surface 113 to which the gasket is fixedly attached. In some embodiments, the width W2 is 50% or less that of width W1. Preferably, the gasket may be laterally insert and offset proximate to the stepped corner 114 of the panel peripheral edge 110. This protects the gasket 150 from damage during handling of the ceiling panel 100 along the process lines in the factory, when packaging the panels in shipping cartons, and handling the ceiling panels in the field at the jobsite during the ceiling system.

In some embodiments, the gasket 150 may be adhesively attached to the ceiling panel using a suitable adhesive 120. The adhesive may be pre-applied and coated onto the gasket in one embodiment. In one embodiment, a pressure-sensitive adhesive may be used such as without limitation preferably an acrylic adhesive. In contrast to rubber-based adhesives, acrylic are initially less tacky but develops a strong bond to the ceiling panel when cured over a period of time after positioning on the panel. Acrylic is also stable up to about 140 degrees F. (Fahrenheit) to which the ceiling panels may be exposed during shipping in warmer months and climates. Other suitable types of adhesives however may be used and the invention is not limited to acrylic adhesive alone.

The present gasketed ceiling system provides a unique combination and balance of ceiling panel weight and gasket material properties to collectively achieve both an effective air leakage seal at the grid to ceiling panel interface, and minimal exposed gasket reveal at the support grid which is visible to occupants of the occupied space below the panels to maintain good visual aesthetics.

In one non-limiting embodiment, the resiliently compressible gasket 150 may be formed of polymeric foam. The foam material may be cross-linked closed cell polyethylene (PE) foam in one implementation having a density from about and including 4 lbs./cu. ft. (pounds/cubic foot) to 6 lbs./cu. ft. (measured per industry test standard ASTM D3575). Suitable PE foam gasket materials are available from suppliers such as Pres-On of Bolingbrook, Illinois (e.g. product PF1606), Lamatek of West Deptford, New Jersey (product E series 4 #), and others. The gasket may be obtained in roll form having an adhesive coating (e.g. acrylic or other) pre-applied preferably on one side only.

The density and original uncompressed thickness T1 of the PE foam gasket (i.e. undeformed without any load on the gasket material) is pre-selected in cooperation with the weight of the ceiling panel specifically selected to collectively provide the desired target compression and reduction in thickness (e.g. height) of the foam gasket in the compressed condition when the ceiling panel 100 is fully mounted onto the grid support members 202, 204 of the support grid. In one non-limiting embodiment, the ceiling panel 100 has a weight selected to compress the gasket 150 by at least 10% of the uncompressed thickness T1, preferably at least about 40% in some implementations, and preferably about at least 50%. Accordingly, the compressed thickness T2 of the foam gasket 150 in one scenario may be about 90% of the original uncompressed thickness T1 with 10% foam compression in some implementations. In one preferred embodiment, however, the inventors discovered that a final compressed thickness T2 of about 50% of T1 (about 50% foam compression) resulted in a good leakage-resistant tight air seal at the interface between the grid support members and the ceiling panel as further described in the air leakage test results presented herein. As measured by ASTM Test Standard D3575, the foam gasket in some preferred embodiments which resulted in the good air seal may have a compression set (% of original uncompressed thickness T1) of 16% and compression strength @ 25% deflection of 13 psi for 4 lb. density PE foam. If 6 lb. PE foam is used, the compression set (% of original uncompressed thickness T1) may be preferably 11% and compression strength @ 25% deflection is 35 psi.

In one embodiment, the desired target final compressed thickness T2 of gasket 150 may be about 1/32 inches. This value provides a virtually undetectable gap (visually) at the interface between the bottom flange of the grid support members 202, 204 and ceiling panel 100. This conceals the gasket from view in the occupied space 250 below the ceiling system, particularly when used in conjunction with a tegular-edged ceiling panels in which interior portions of the panel inboard of the peripheral edges 110 project downward below the bottom grid face of the grid support members (see, e.g. FIG. 4). When using the PE foam gasket material having a density of 4 lbs./cu. ft., the original uncompressed thickness T1 of the gasket may therefore be about 1/16 inches to obtain a 50% reduction in thickness. This can be achieved by using a ceiling panel 100 having a correspondingly selected weight of about 4 lbs. for the 4 lbs./cu. ft. density PE foam gasket. To achieve the same target 50% reduction in thickness using the 6 lbs./cu. ft. density PE foam gasket starting with the same initial uncompressed thickness T1 of 1/16/ inches, the ceiling panel 100 would be selected to have a weight greater than 4 lbs. due to the denser slightly less compressible foam. Since ceiling panels are typically a standardized item within certain product lines with set weights which depend on the size of the panel, the standard ceiling panel of the ceiling panel may actually dictate the required density and original uncompressed thickness T1 of the resiliently compressible PE foam gasket 150 required to achieve the desired reduction in thickness and target final compressed thickness T2 of gasket when compressed by the weight of the panel.

In order to provide a visually undetectable gasketed ceiling panel, the initial uncompressed thickness T1 may preferably be no greater than 1/8 inch for a 4 or 6 lbs./cu. ft. density PE foam product, however more preferably no greater than 1/16 inch as noted above. The final target compressed thickness T2 may be preferably no greater than 1/16 inch, however more preferably 1/32 inches as noted above for the PE foam. The final target compressed thickness T2 is applicable for whatever type of foam polymeric gasket material may be usual to visually conceal the ceiling panel gasket.

It bears noting that the deformability properties or "softness" of the 4 or 6 lb. PE foam material advantageously provides a strong bond to the peripheral edges 110 of the panel by allowing the foam to at least partially seep into the small surface nooks and recesses in the peripheral edges of the panel. This effectively interlocks the gasket material with the ceiling panel via the acrylic adhesive film disposed between the gasket and peripheral panel edge. This advantageously prevents dislodgement of the gasket when packaging multiple panels into shipping cartons/containers, transport/shipping, and handling the panels in the field during installation onto the support grid.

It bears noting that other density foam gaskets of the same or different polymeric materials, and corresponding other weights of ceiling panels may be used in combination to achieve the at least 10% reduction in thickness and target final compressed thickness T2 of gasket 150. When polyethylene (PE) foams are used, higher density cross-linked polyethylene foams are generally preferred for the present air seal gasket 150 application in contrast to lower non-cross linked PE foams which are generally too compressible and flatten out. In other possible embodiments, polyvinylchloride (PVC), neoprene, polyurethane, or neoprene foam gaskets may be used. In addition, foams of any type having a density less than 4 lbs./cu. ft. may be used in other less preferred but acceptable embodiments provided adequate protection is provided to guard against damage during ceiling panel fabrication, shipping, and handling (e.g. peel-away protective liners). The invention is accordingly not limited to the type or density of gasket material or weight of the ceiling panel to those examples provided herein for illustrative purposes only.

In certain non-limiting preferred embodiments, the resiliently compressible gasket 150 is adhered to the peripheral edges 110 of the ceiling panel 100 as part of an inline fabrication process under factory controlled conditions. The gasketed ceiling panels are therefore ready for packaging in the shipping carton or container and transport to the installation jobsite in the field for installation on the suspended ceiling support grid 200.

An exemplary method for forming and handling a ceiling panel with an air seal comprising gasket 150 includes the basic steps of providing a ceiling panel workpiece, cutting the workpiece to form a plurality of cut peripheral edges, edge coating the cut peripheral edges, adhering the gasket to coated peripheral edges, and packaging the ceiling panel in a shipping container. The ceiling panel 100 is initially formed by known method such as mixing various constituent materials into a slurry such as recycled newspaper, perlite, fiberglass, mineral wool, and binding agents for mineral fiber panels. The slurry is cast in a mold and cured such as under heat to form a solid rough ceiling panel workpiece. The workpiece is dimensionally cut to size in the next step of the assembly line (if not already formed to near-final or final size during the casting). At least the bottom surface which faces the occupied space 250 is painted. Tegular edges 110 if used are then cut if not already formed during the initial dimensional cutting of the panel. The inline panel fabrication process continues with running the peripheral edges through an edge coating machine which seals the raw cut edges with one of the paint-like edge coating materials previously described herein, or others. The edge coating is then dried and hardened ("cured") over a period of time, after which the gasket 150 is adhesively applied to at least the load bearing surface 113 of the peripheral edges all the way around the perimeter of the panel 100. An acrylic adhesive may be used in one non-limiting embodiment for fixedly attaching the gasket 150 to the ceiling panel. The gasket material may be provided in roll form with pre-applied adhesive protecting a peelable plastic film. Alternatively, before the edge coating material completely hardens on the panel peripheral edge, the gasket (having no pre-applied adhesive) may be pressed into the wet edge coating. When the edge coating hardens, the gasket becomes integrally incorporated into the panel along with the edge coating without use of a separate adhesive product which advantageously reduces fabrication costs. The edge coating material is not an adhesive or glue-type product.

The gasketed ceiling panels 100 come off the assembly line and are packaged into appropriate shipping cartons or containers which include multiple gasketed panels.

The method continues with transporting the shipping container to an installation jobsite, removing the ceiling panels 100 from the shipping containing, mounting the ceiling panel on a pre-installed overhead support grid, and compressing the gasket between the support grid (i.e. grid support members 202, 204 which forms an air leakage resistant seal at an interface between the ceiling panel and the support grid. Each ceiling panel 100 is supported by opposing pairs of longitudinal grid support members 202 and lateral grid support members 204 which define the grid opening 208 in which the ceiling panel is positioned in its final installed state.

Figure 7:
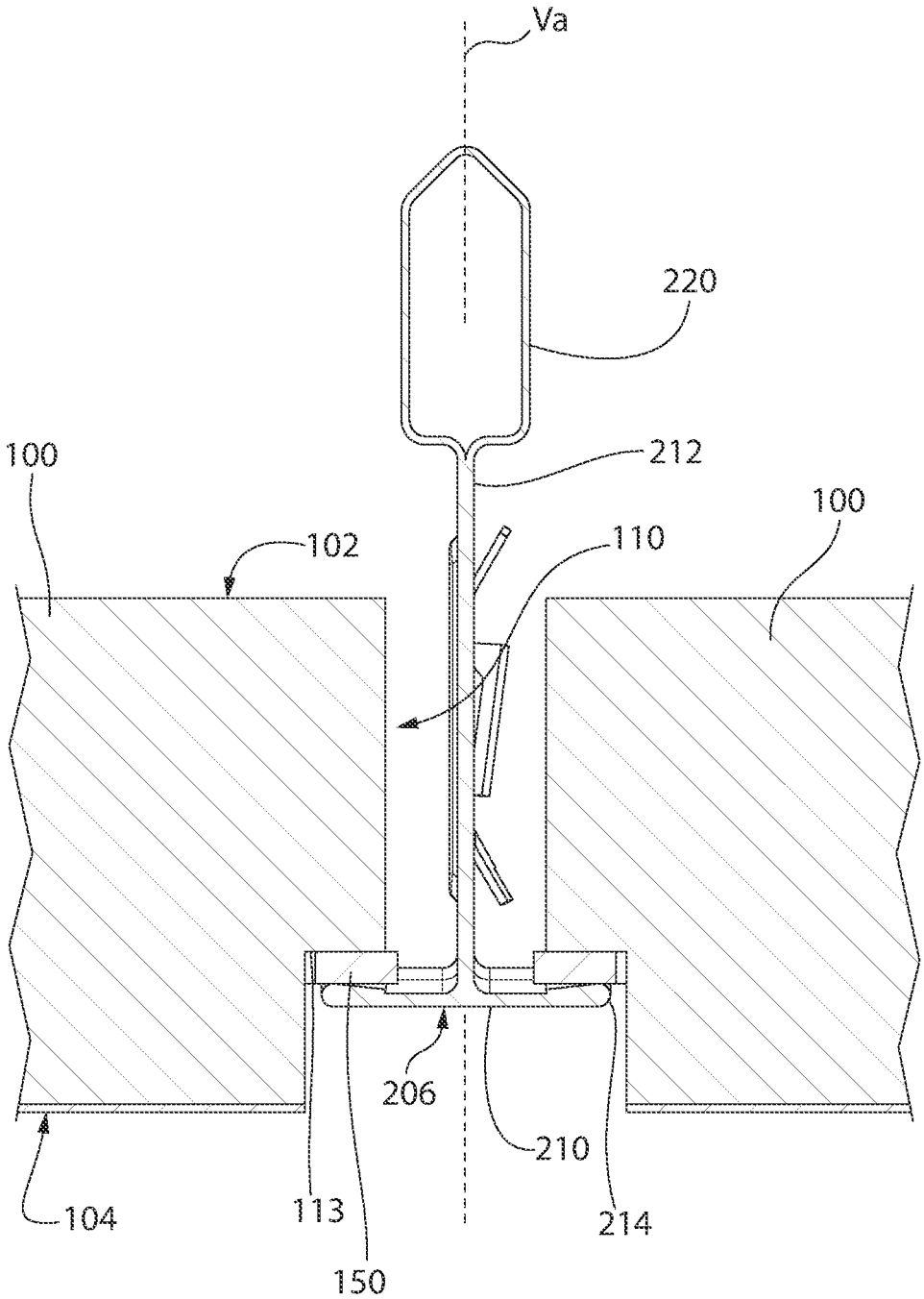
FIG. 7 is a partial side cross-sectional view of the ceiling system showing an alternative embodiment of the support grid.

FIG. 4 shows a ceiling system comprising the hung ceiling panel 100 with gasket 150 compressed between one peripheral edge 110 of the panel a first embodiment of a grid support member 202 or 204. The grid support member may be a 15/16 inch T rail in one embodiment. The gasketed ceiling panel retards air exchange between the plenum 251 above the panels and the occupiable space 250 below. FIG. 7 shows essentially the same but the grid support member has a narrower profile with laterally shorter bottom flange 210 as shown which results in a less visible grid face to the occupiable space 250 below the panels. This grid support member may be a 9/16 T rail in another embodiment.

The gasketed ceiling panels of the invention may provide for beneficial acoustic properties. The American Society for Testing and Materials (ASTM) has developed test method E1414 to standardize the measurement of airborne sound attenuation between active space 2 and plenum space 3 or from a room to room. The rating derived from this measurement standard is known as the Ceiling Attenuation Class (CAC). Ceiling materials and systems having higher CAC values have a greater ability to reduce sound transmission through a plenary space (e.g., sound attenuation function). In certain embodiments, the gasketed ceiling system can provide a CAC rating of at least 35, preferably at least 40. In other embodiments, the gasketed ceiling system has the ability to reduce the amount of reflected sound in a room. One measurement of this ability is the Noise Reduction Coefficient (NRC) rating as described in ASTM test method C423. This rating is the average of sound absorption coefficients at four ⅓ octave bands (250, 500, 1000, and 2000 Hz), where, for example, a system having an NRC of 0.90 has about 90% of the absorbing ability of an ideal absorber. A higher NRC value indicates that the material provides better sound absorption and reduced sound reflection—sound absorption function.

Air Leakage Test Results

An air leakage test for determining the performance of different gasket materials versus no gasket on the ceiling panel was conducted per industry test standard ASTM-E283. Ceiling panels measuring 2 ft.×2 ft. (4 lbs. weight each) were mounted on T-grid members with and without gaskets and the Effective Leakage Area (ELA) measured in units of $cm^2/m^2$ was determined per the test standard. Lower ELA results indicate lower air leakage rates when a confined air-tight space formed by a box frame beneath the panels is pressurized per the test standard. This one-way air leakage test measures leakage between the pressurized space below the panels to the space above. ELA represents the size (area) of a hole/orifice (measured in units of $cm^2/m^2$) which produces air leakage equivalent to the total air leakage measured for the test ceiling panel/grid setup. A discharge coefficient of Cd=1.0 and a reference pressure of 4.0 [Pa] were used in the test for ELA calculations.

Figure 8:
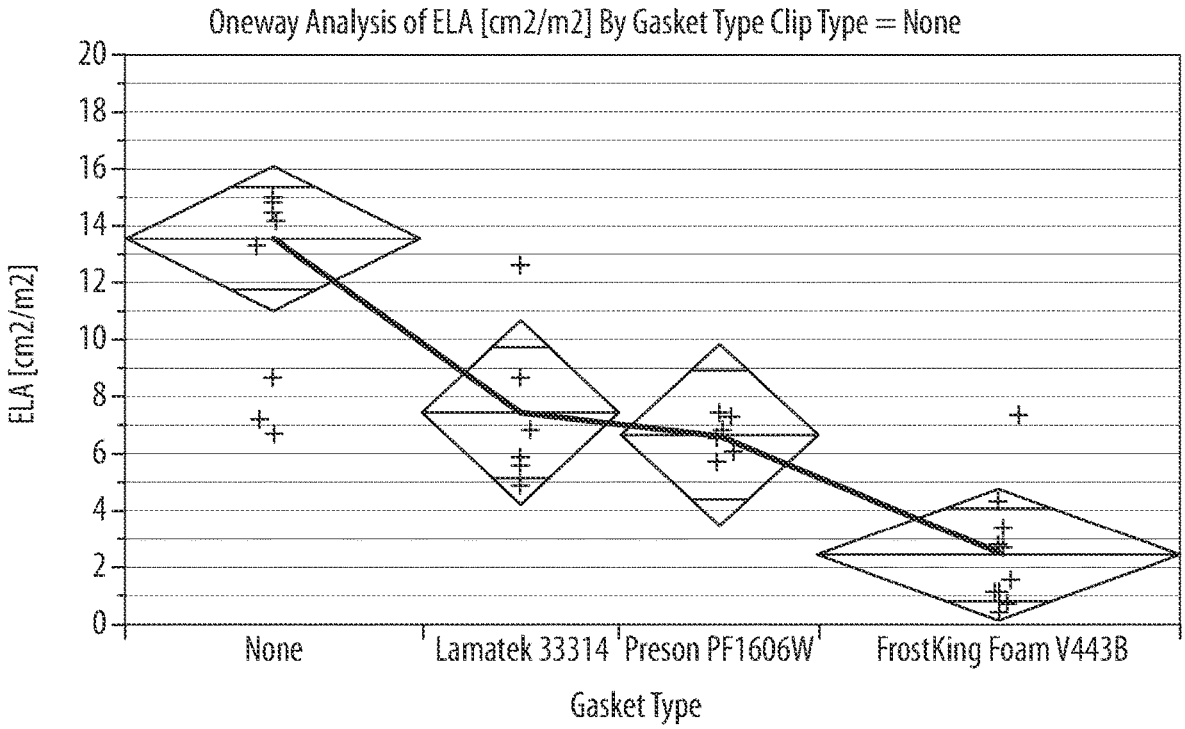
FIG. 8 is a graph depicting the results of an air leakage test of various gasketing materials conducted per ASTM-E283 air leakage test standard.

The test results are graphically displayed in FIG. 8. The center horizontal line in each diamond boundary represents the mean/average value for that gasket product.

The graph shows that the ceiling system setup without a gasket adhered to the ceiling panel had an ELA greater than 10 $cm^2/m^2$ (mean/average=13.6 $cm^2/m^2$). Each "cross" on graph being an individual data point. A ceiling panel with attached resiliently compressible gasket significantly reduced the air leakage at the interface between the grid support members and panel. Both the Lamatek 33314 and Preson PF1606W were 1/16 inch thick (uncompressed) PE foam gaskets reduced to at least 40% original thickness by the ceiling panels, specifically 50% in the test installation. Six test runs were performed for these products. The mean/average leakage rates represented by ELA was less than 8 $cm^2/m^2$ for either PE foam (individual mean/average values for each product shown in table with graph). The FrostKing V443B was a thicker 3/16 inch thick (uncompressed) polyvinylchloride (PVC) foam gasket. Eleven test runs were performed for this product. The mean/average ELA was less than 3 $cm^2/m^2$. Although the air leakage rate for the PV foam is lower, this gasket material was thicker potentially making it more visible in the finished ceiling system and is less environmentally friendly than PE foam.

Acoustical Characterization Results

A variety of 2×2 panels either not having ("No GA") or having ("GA") a gasket present were prepared and evaluated for their acoustical performance as measured by Ceiling Attenuation Class (CAC) rating and Noise Reduction Coefficient (NRC) rating. Testing was performed as per ASTM E1414 and ASTM C423. Results are shown in Table 1.

TABLE 1

Characterization of acoustical performance.

| Test Product | Grid Type | No GA CAC | GA CAC | No GA NRC | GA NRC |
|---|---|---|---|---|---|
| Scrim faced mineral fiber tile with tegular edge | Standard 9/16" | 35 | 42 | 0.70 | 0.70 |
| Scrim faced mineral fiber tile with tegular edge | Bolt slot | 35 | 40 | 0.70 | 0.70 |
| Scrim faced mineral fiber tile with tegular edge | Standard 9/16" | 35 | 41/42 | 0.70 | N/A |
| Scrim faced mineral fiber tile with tegular edge | Standard 9/16" | 35 | 43 | 0.70 | 0.70 |
| Scrim faced mineral fiber tile with tegular edge | Standard 9/16" | 38 | 43 | 0.80 | 0.80 |
| Scrim faced mineral fiber tile with tegular edge | Bolt slot | 38 | 43 | 0.80 | 0.80 |
| Scrim faced mineral fiber tile with tegular edge | Standard 9/16" | 38 | 40 | 0.80 | N/A |
| Fissured mineral fiber tile with tegular edge | Standard 15/16" | 35 | 45 | 0.70 | 0.75 |
| Fire Rated Fissured mineral fiber tile with tegular edge | Standard 15/16" | 40 | 46 | 0.70 | 0.75 |
| Scrim faced mineral fiber tile with tegular edge | Standard 9/16" | 40 | 41 | 0.80 | 0.80 |
| Foil backed Fiberglass tile with tegular edge | Standard 9/16" | 26 | 30 | 0.90 | 0.90 |
| Scrim faced low back ohm mineral fiber tile with tegular edge | Standard 9/16" | 28 | 29 | 0.90 | 0.90 |
| Scrim faced mineral fiber tile with square edge | Standard 15/16" | 38 | 43/42 | 0.80 | 0.80 |
| Scrim faced mineral fiber tile with square edge | Standard 15/16" | 38 | 41 | 0.70 | 0.70 |
| Fissured mineral fiber tile with square edge | Standard 15/16" | 35 | 42 | 0.70 | 0.70 |

As shown in Table 1, there is on average a 5 dB increase in room to room sound attenuation (represented by CAC) when gasketed panels were used as compared to non-gasketed panels while simultaneously yielding no negative impact on sound absorption (represented by NRC). This is an unexpected and surprising result in that typically one needs to double the mass of an object, such as a ceiling tile, to gain an attenuation increase of that magnitude, this is known within the art of acoustics as the 5 dB rule. Additionally, changes made to an acoustical product to increase its attenuation (such as increasing thickness or density) will typically have a detrimental impact on one or more other aspects of the product. Increasing density increases material cost and usually results in a reduction in sound absorption rating, while increasing thickness also increases material cost and will typically make the product more difficult to install. The present gasketed ceiling system overcomes such limitations by increasing attenuation without the need for increasing thickness or density.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A gasketed ceiling panel comprising:

a ceiling panel having a unitary body formed of a fiber material, the ceiling panel comprising a peripheral edge and a weight; and a resilient gasket fixedly attached directly to the unitary body at the peripheral edge of the ceiling panel by an adhesive that directly contacts the fiber material, the gasket having an uncompressed thickness;

wherein the ceiling panel is configured to compress the gasket against a support surface under the weight of the ceiling panel by about 40 percent to about 50 percent.

2. The gasketed ceiling panel according to claim 1, wherein the gasket is formed of polyethylene foam having a density between and including 4 pounds/cubic foot to 6 six pounds/cubic foot.

3. The gasketed ceiling panel according to claim 1, wherein the ceiling panel is configured to compress the gasket against the support surface under the a weight of the ceiling panel by about 50 percent.

4. A gasketed ceiling panel comprising:

a unitary ceiling panel formed of a fiber material, the unitary ceiling panel comprising a top major surface opposite a bottom major surface and a peripheral edge extending between the top major surface and the bottom major surface, the peripheral edge comprising a stepped tegular profile that includes a load bearing surface, the load bearing surface facing a same direction as the bottom major surface; and a resilient gasket directly attached to the load bearing surface of the peripheral edge of the unitary ceiling panel by an adhesive that directly contacts the fiber material, the resilient gasket formed of polymeric foam having a density ranging between 4 pounds/$ft^3$ to 6 pounds/$ft^3$.

5. The gasketed ceiling panel according to claim 4, wherein the resilient gasket in an uncompressed state has a thickness ranging from about ⅛ of an inch to about 1/16 of an inch.

6. The gasketed ceiling panel according to claim 4, wherein the polymeric foam is selected from one or more of polyethylene foam, polyvinylchloride foam, neoprene foam, polyurethane foam.

7. The gasketed ceiling panel according to claim 4, wherein the fiber material is selected from one or more of fiberglass, mineral fiber, and recycled newspaper.

8. The gasketed ceiling panel according to claim 4, wherein the top major surface of the unitary ceiling panel comprises the fiber material.

9. A gasketed ceiling system comprising:

a ceiling grid support member;

a ceiling panel having a unitary body formed of fiber material, the ceiling panel having a weight and comprising a peripheral edge configured to engage the grid support member;

a resilient gasket fixedly attached directly to the unitary body at the peripheral edge of the ceiling panel by an adhesive, the gasket having an uncompressed thickness;

wherein the gasket is configured to be interspersed between the peripheral edge and the grid support member, and wherein the ceiling panel is configured to compress the gasket against the ceiling grid support member under the weight of the ceiling panel by about 40 percent to about 50 percent of the uncompressed thickness.

10. The gasketed ceiling system according to claim 9, wherein the adhesive directly contacts the fiber material.

11. The gasketed ceiling system according to claim 9, wherein the grid support member is T-shaped.

12. The gasketed ceiling system according to claim 9, wherein the gasket is linearly elongated and extends for an entire length of the peripheral edge of the ceiling panel.

13. The gasketed ceiling system according to claim 9, further comprising:

a plurality of grid support member arranged to collectively define a grid opening;

the ceiling panel positioned in the grid opening, the ceiling panel comprising a plurality of peripheral edges collectively defining a perimeter;

the gasket comprising one or more pieces extending perimetrically around the entire ceiling panel to form a continuous air-leakage resistant barrier at an interface between the grid support members and the ceiling panel.

14. The gasketed ceiling system according to claim 9, wherein the gasket is formed of polyethylene foam having a density between and including four pounds/cubic foot to six pounds/cubic foot.

15. The gasketed ceiling system according to claim 14, wherein the ceiling panel is configured to compress the gasket against the ceiling grid support member under the weight of the ceiling panel by about 50 percent of the uncompressed thickness for the four pound/cubic foot polyethylene foam.

16. The gasketed ceiling system according to claim 15, wherein the gasket has the uncompressed thickness no greater than ⅛ inch and a compressed thickness of no more than about 1/32 inch.

17. The gasketed ceiling system according to claim 9, wherein the gasket is attached to a downward facing load bearing surface on the peripheral edge of the ceiling panel.

18. The gasketed ceiling system according to claim 17, wherein the gasket is compressed between the load bearing surface of the ceiling panel and an upward facing second support surface of the grid support member.

19. The gasketed ceiling system according to claim 18, wherein the support surface is defined by a bottom flange of the grid support member.

* * * * *